US011148841B2

(12) United States Patent
Singh et al.

(10) Patent No.: US 11,148,841 B2
(45) Date of Patent: Oct. 19, 2021

(54) APPARATUS AND METHOD FOR VACUUM PACKAGING SOLID DRILLING FLUID ADDITIVES

(71) Applicant: GUMPRO DRILLING FLUIDS PVT. LTD, Mumbai (IN)

(72) Inventors: Anilkumar Singh, Mumbai (IN); Swapnil Thakur, Mumbai (IN); Ritesh Bamgude, Mumbai (IN)

(73) Assignee: Gumpro Drilling Fluids PVT. LTD, Mumbai (IN)

( * ) Notice: Subject to any disclaimer, the term of this patent is extended or adjusted under 35 U.S.C. 154(b) by 142 days.

(21) Appl. No.: 16/242,833

(22) Filed: Jan. 8, 2019

(65) Prior Publication Data

US 2019/0210751 A1 Jul. 11, 2019

(30) Foreign Application Priority Data

Jan. 8, 2018 (IN) ..... 201821000836
Dec. 31, 2018 (IN) ..... 201821000836

(51) Int. Cl.
*B65B 31/02* (2006.01)
*B65B 1/26* (2006.01)

(52) U.S. Cl.
CPC ..... *B65B 31/024* (2013.01); *B65B 1/26* (2013.01)

(58) Field of Classification Search
CPC ..... B65B 31/024; B65B 1/26
USPC ..... 53/434, 427, 432, 527
See application file for complete search history.

(56) References Cited

U.S. PATENT DOCUMENTS 2,241,943 A * 5/1941 Berch ..... B65B 31/024 53/433
2,481,611 A * 9/1949 Moore ..... B65B 1/24 53/525
4,292,786 A * 10/1981 Long ..... B65B 1/24 53/374.9
4,683,702 A * 8/1987 Vis ..... B65B 31/024 53/433
5,097,648 A * 3/1992 Berner ..... B65B 31/046 53/371.8
5,220,768 A * 6/1993 Aarts ..... B65B 31/025 53/405
5,228,270 A * 7/1993 Aarts ..... B65B 61/24 53/432

(Continued)

*Primary Examiner* — Dariush Seif
(74) *Attorney, Agent, or Firm* — Thorpe North & Western, LLP

(57) ABSTRACT

This invention relates to an apparatus and method for vacuum packaging drilling fluid additives and is particularly effective for low bulk density material. Vacuum sealing technology is employed to decrease the volume of the additive, thereby enabling packaging of larger quantity of additive per bag, effective utilization of storage space and reduced transportation costs. The invention overcomes the drawback of conventional vacuum packing machines where the material being packaged drifts out of the packaging bag into the vacuum chamber on vacuum creation and further deposits on the sealable portion at the open end of the bag leading to ineffective sealing of the bag opening. The apparatus of the invention is modified to increase the head-space between the sealing element of the apparatus and drilling fluid additive being sealed, thereby eliminating the movement of the additive into the vacuuming chamber and deposit on the bag opening.

9 Claims, 5 Drawing Sheets

(56) References Cited

U.S. PATENT DOCUMENTS 5,678,387 A * 10/1997 Aarts ..... B65B 31/024 53/434
5,711,136 A * 1/1998 Carcano ..... B65B 31/06 53/434
5,887,409 A * 3/1999 Leal Pereira Da Silva ..... B65B 31/046 53/284.7
6,343,459 B1 * 2/2002 Seaward ..... B65B 31/06 53/370.6
6,742,320 B1 * 6/2004 Rapparini ..... B65B 31/022 53/403
7,516,594 B1 * 4/2009 Terminella ..... B29C 66/43121 53/86
7,739,857 B2 * 6/2010 McLaughlin ..... B30B 9/3032 53/408
7,958,696 B2 * 6/2011 McLaughlin ..... B65B 31/047 53/408
8,099,930 B2 * 1/2012 Moessnang ..... B65B 31/06 53/434
8,104,520 B2 * 1/2012 Ours ..... B65B 11/045 141/10
8,281,558 B2 * 10/2012 Hiemeyer ..... F16L 59/065 53/432
9,266,630 B2 * 2/2016 Peterson ..... B65B 9/2049
10,006,581 B2 * 6/2018 Kuhn ..... B65B 31/024
10,065,752 B2 * 9/2018 Steffens ..... B65D 85/10
2006/0283149 A1 * 12/2006 Passini ..... B65B 31/06 53/434
2009/0260326 A1 * 10/2009 Grimm ..... B65B 61/005 53/434
2010/0215813 A1 * 8/2010 Peterson ..... B65B 9/207 426/106
2011/0258967 A1 * 10/2011 Dietrich, Jr. ..... B65B 39/08 53/432
2012/0180435 A1 * 7/2012 Stelluti ..... B65B 1/24 53/469
2016/0084424 A1 * 3/2016 Kuhn ..... F16L 59/065 53/427
2017/0001796 A1 * 1/2017 Nelson ..... B32B 7/04

* cited by examiner

APPARATUS AND METHOD FOR VACUUM PACKAGING SOLID DRILLING FLUID ADDITIVES

RELATED APPLICATIONS

This application claims priority to Indian Patent Application No. 201821000836, filed on Dec. 31, 2018, and to Indian Provisional Patent Application No. 201821000836, filed on Jan. 8, 2018, which are each incorporated herein by reference.

FIELD OF THE INVENTION

The present invention relates to an apparatus for vacuum packaging solid drilling fluids additives and a method for operation thereof. The present invention employs vacuum sealing for packaging solid/powdered drilling fluids additives, thereby reducing the volume of the material and enabling greater utilization of space. The apparatus of the present invention is a vacuum sealing machine advantageously modified to carry out packaging of solid drilling fluids additives having low bulk density.

BACKGROUND OF THE INVENTION

Drilling fluids have a number of functions, including but not limited to, lubricating the drilling tool and drill pipe which carries the tool, providing a medium for transporting formation cuttings from the well to the surface, counterbalancing formation pressure to prevent the inflow of gas, oil, and/or water from permeable or porous formations to the wellbore, preventing the loss of drilling fluids to empty spaces and to permeable or porous formations, maintaining hole stability prior to setting the casing, minimizing formation damage, and holding the drill cuttings in suspension, especially in the event of a shutdown in drilling and interruption of pumping of the drilling mud.

Drilling fluids incorporate drilling fluids additives including lost circulation materials, lubricant powder and emulsifier powder which have low bulk density and occupy greater volume.

Conventionally known methods of packaging low bulk density drilling fluid additives result in unwieldy and bulky packages leading to ineffective utilization of space in the shipping container and increased shipping costs. Additionally, the space is the packaging bag is not used optimally. These irregularly shaped packages have increased chances of toppling over when stacked in a pile thereby raising an important safety issue. Further, conventional methods of packaging may lead to loss in product quality due to oxidation over a period of time.

U.S. Pat. No. 7,958,696 B2 describes the use of vacuum packaging and vacuum packing techniques. This invention is utilized for packaging bulk material, bulk material fibre or fibrous materials. However, the apparatus of this invention does not provide a solution to finely powdered material floating upwards and spilling out of the open end of the bag during vacuum packaging. Further, this invention also uses compression of fibres as a means to reduce volume.

Therefore, there is a need for a simplified and improved apparatus and method for packaging low bulk density drilling fluid additives which overcomes the limitations of such traditional packaging methods.

This invention resides in an apparatus and method for vacuum packaging which employs vacuum sealing for packaging drilling fluid additives in order to provide an effective way to reduce the volume of the packaged material and at the same time overcome the problem of low bulk density material drifting out of the packaging bags on vacuum creation. The present invention yields packages which are brick shaped thus enabling fitting of more packaged material on the pallet.

OBJECTS OF THE INVENTION

It is an object of the invention to provide a method and apparatus that employs vacuum sealing technology for packing solid drilling fluid additives.

It is another object of the invention to reduce the volume of packed drilling fluid additives, especially those having low bulk density, thereby increasing the quantity of product packed per package.

It is yet another object of the invention to enable greater utilization of space during transportation of drilling fluid additives, thereby reducing logistics costs.

It is another object of the invention to enable tailoring of package dimensions to provide ease in palletizing for transport and/or storage.

It is an objection of the present invention to increase safety in handling drilling fluid additives by yielding regular shaped packages that do not topple when stacked.

It is a further object of the invention to eliminate/substantially reduce loss of product quality due to oxidation, thereby increasing shelf life of the product.

It is another object of this invention to provide a solution to the problem of low bulk density material floating upwards and spilling out of the open end of the bag during vacuum packaging.

SUMMARY OF THE INVENTION

This invention relates to an apparatus and method for vacuum packaging drilling fluid additives and is particularly effective for low bulk density material. Vacuum sealing technology is employed to decrease the volume of the additive, thereby enabling packaging of larger quantity of additive per bag, effective utilization of storage space and reduced transportation costs. The invention overcomes the drawback of conventional vacuum packing machines where the material being packaged drifts out of the packaging bag into the vacuum chamber on vacuum creation and further deposits on the sealable portion of the open end of the bag leading to ineffective sealing of the bag opening. The apparatus of the invention is modified to increase the headspace between the sealing element of the apparatus and drilling fluid additive being sealed thereby eliminating the movement of the additive into the vacuuming chamber and additive deposit on the bag opening.

BRIEF DESCRIPTION OF THE DRAWINGS

The preferred embodiment of the invention is described in detail below, with reference to the attached figures, wherein.

DETAILED DESCRIPTION OF THE INVENTION

The present invention is particularly effective for packaging drilling fluid additives which are light and have low bulk density. When such additives are packed and sealed into bags by conventional methods, without using vacuum sealing technology, it is observed that a 25 kg bag can accommodate only 11 kg of material as lower bulk density material occupies greater volume. This results in less than optimum quantity of material by weight being transported per shipping container, leading to increased transportation costs and therefore drilling costs. The present invention is a modified vacuum sealing machine.

Figure 1:
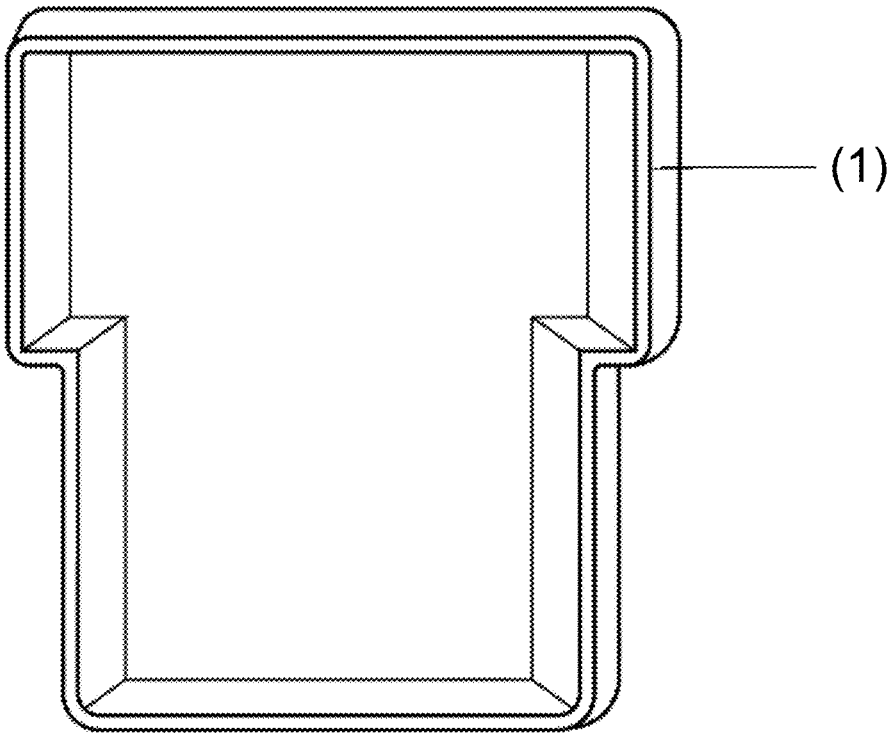
FIG. 1 is a front view of the vacuum sealing chamber of a conventional vacuum sealing machine.
Figure 2:
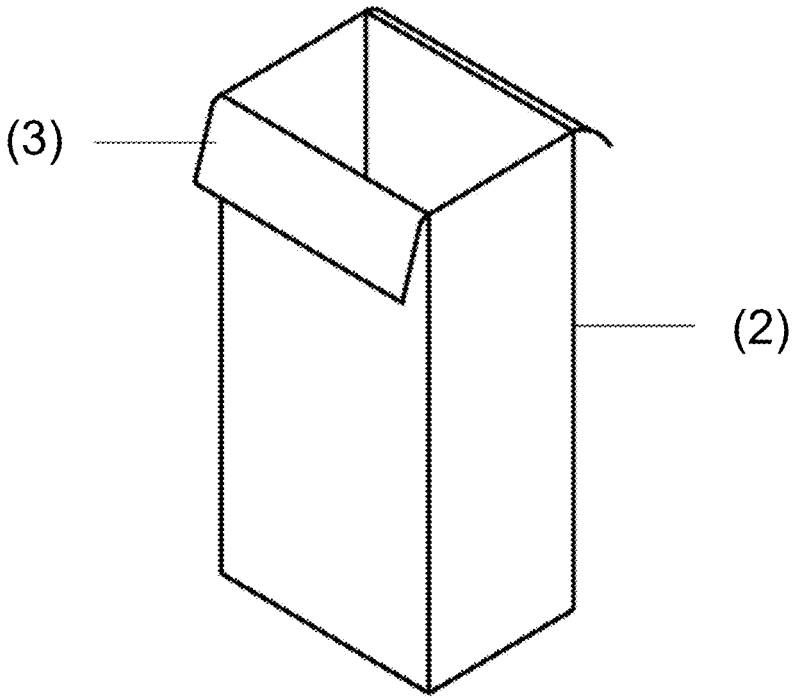
FIG. 2 is a perspective view of a vertically elongated mould of a conventional vacuum sealing machine with a packaging box fitted therein.

When a conventional vacuum sealing machine having a vacuum sealing chamber (1) as illustrated in FIG. 1 and a conventional vertically elongated mould (2) fitted with a packaging box (3) as illustrated in FIG. 2 were used to package low bulk density solid drilling fluid additives, when the mould (2) was filled with the additive, the additive was placed in close proximity to the sealing element due to the height of the mould (2). This resulted in some of the additive drifting out of open end of the packaging box (3) during vacuum creation and entering the vacuum sealing chamber (1) of the apparatus. When a packaging bag was used, it was noted that some of the additive was deposited on the sealable portion at the opening of the bag resulting in faulty sealing of the bag at the time of sealing after evacuating air from the bag. This drawback was attempted to be solved by increasing the height of the bag. However, this too resulted in faulty sealing of the bag.

Several tests were carried out, to find the optimum distance between the material being packaged and the sealing element of the vacuum sealing machine, to prevent material being sucked into the vacuum chamber during vacuum creation. It was observed that a minimum distance of about 250 mm was essential between the drilling fluid material and the sealing element of the apparatus was essential to prevent the material from drifting upwards during vacuum creation. In order to provide this minimum distance between the additive in the mould and the sealing element of the apparatus, the dimensions of the mould and the vacuum chamber were modified.

Figure 3:
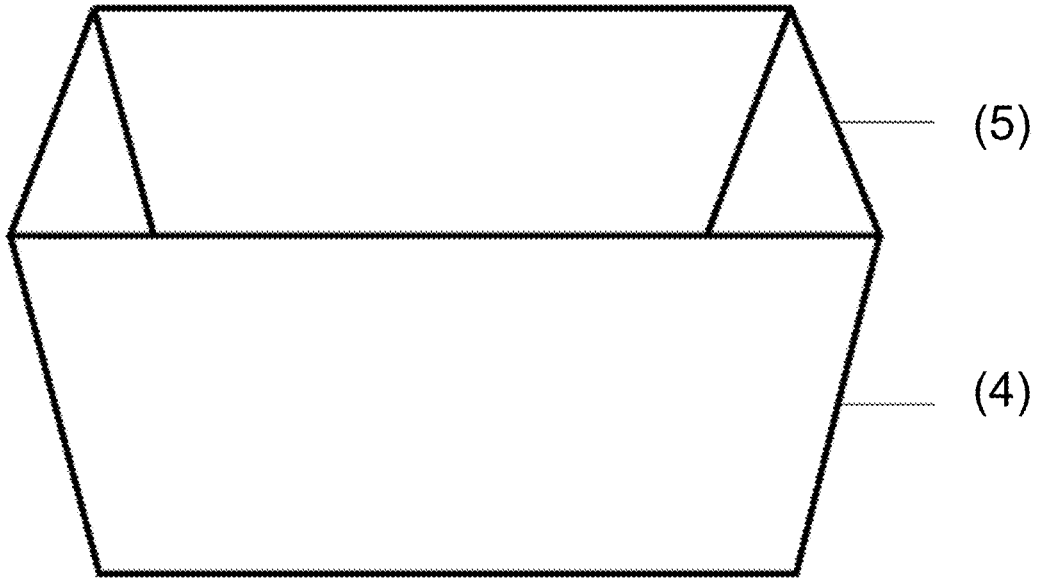
FIG. 3 is a perspective view of the modified mould of the present invention.
Figure 4:
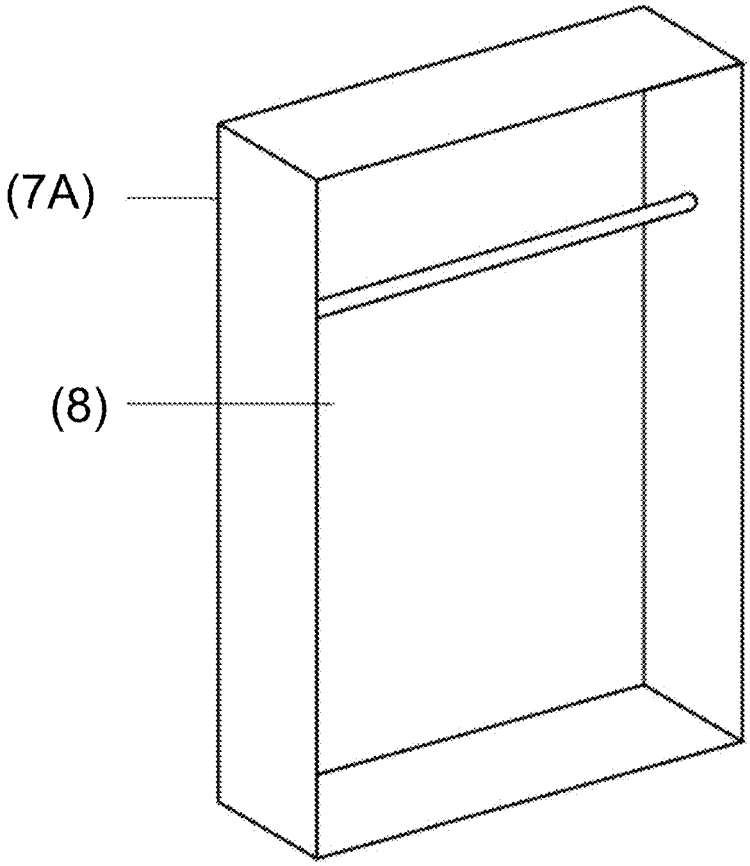
FIG. 4 is a perspective view of the modified vacuum sealing chamber of the present invention.
Figure 7:
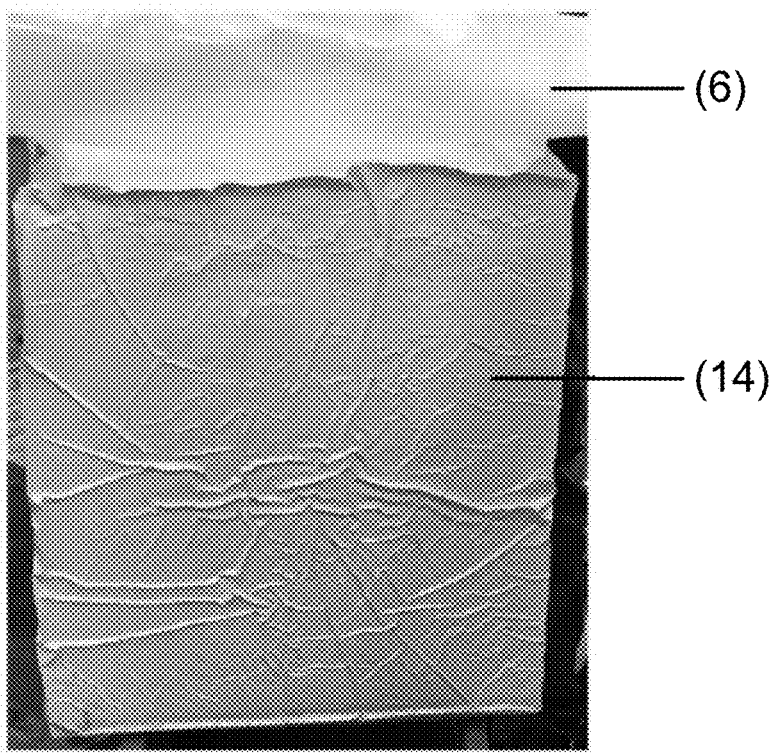
FIG. 7 is brick shaped vacuum packaged additive packaged by the present invention.

Illustrated in FIG. 3 is the modified horizontally elongated, rigid and hollow, open-topped mould (4) of the invention having an opening (5) for receiving a packaging bag (6) depicted in FIG. 7. FIG. 4 depicts a first portion (7A) and a second portion (7B) of the vacuum sealing machine, said first and second portion adapted to be in sealing engagement during vacuum creation. The first portion (7A) is provided with the modified vacuum chamber (8) sized to accommodate the mould (4), the mould positioned such that it remains open at the top inside the vacuum chamber.

As seen in FIG. 3, in order to at least maintain inner cavity volume of the mould (4) as compared with the volume prior to modification, the height of the mould (4) is decreased and the length increased to horizontally elongate the mould (4). The dimensions of the vacuum sealing chamber (8) are modified to accommodate the increased length of the mould (4).

Figure 5:
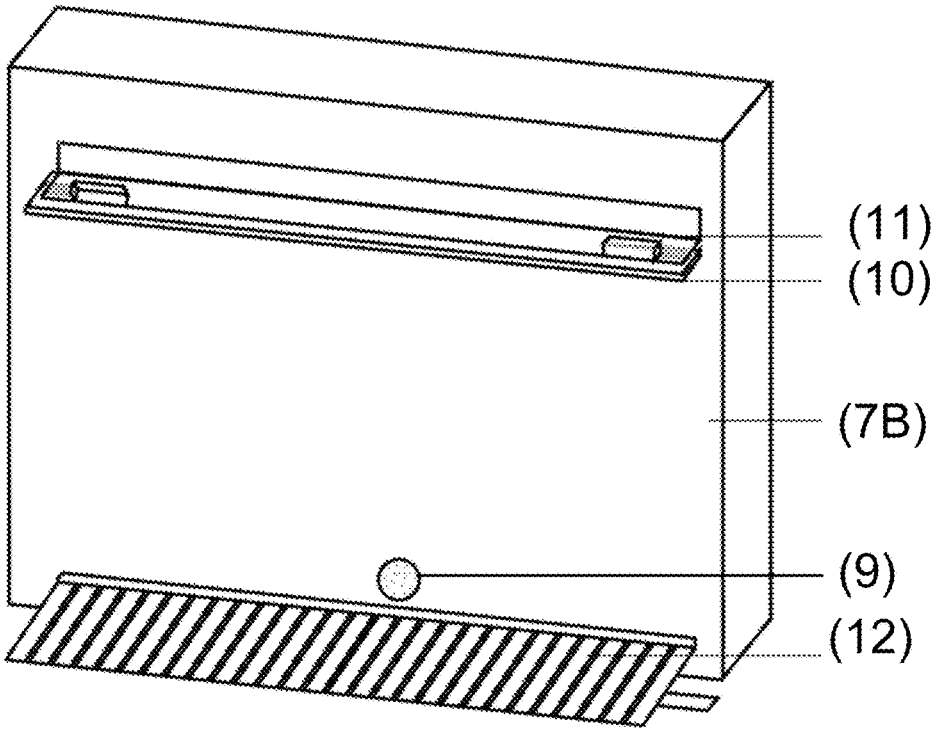
FIG. 5 is a partial sectional view of the present apparatus illustrating its components.
Figure 6:
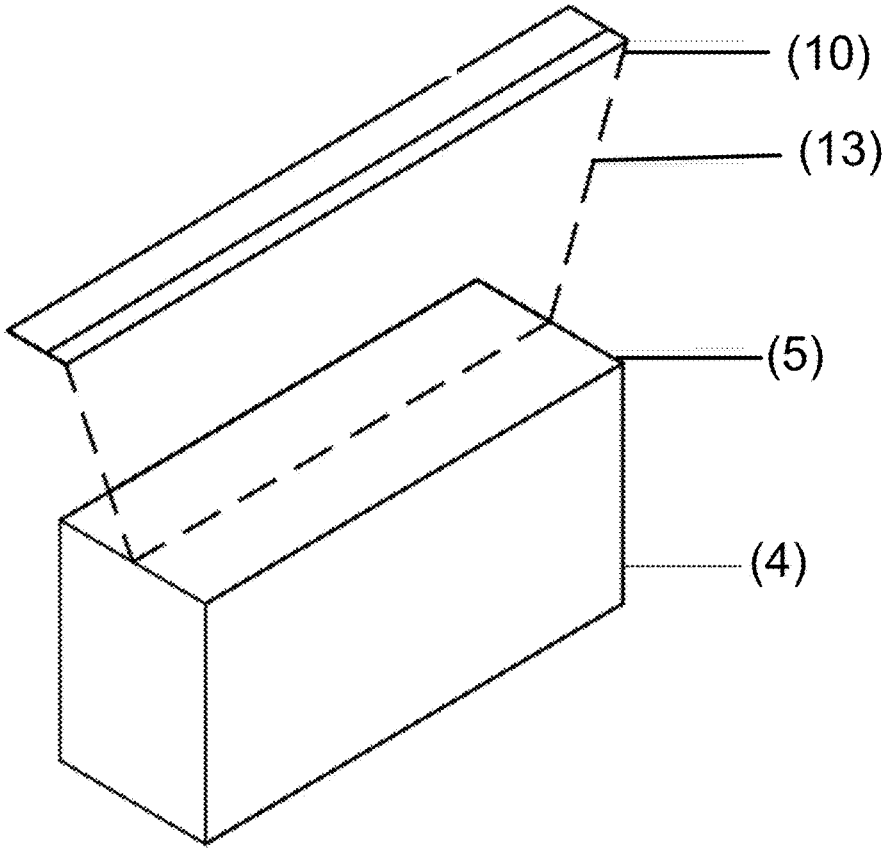
FIG. 6 is a perspective view of the modified mould and sealing element of present invention, in position for vacuum creation.

FIG. 5 shows the second portion (7B) of the vacuum sealing machine, provided with a vacuum source (9) and a sealing element (10). Also shown is a bag holder (11) to which the packaging bag (6) is attached during vacuum creation and a holding rack (12) on which mould (4) is placed. For vacuum creation, the mould (4) filled with solid drilling fluid additive in packaging bag (6) is placed on the holding rack (12) and the open end of the bag (6) is attached to the bag holder (11). The first portion (7A) and second portion (7B) are brought in sealing engagement thereby placing the mould (4) inside the vacuum chamber (8). The placement of the mould (4) and the sealing element (10) in this position is illustrated in FIG. 6. The headspace (13) between the mould opening (5) and the sealing element (10) is at least 250 mm.

When tests were run with the modified vacuum sealing apparatus it was found that even though fine particles were sucked upward on vacuum creation, the distance between the material and the sealing element (10) prevented the particles from flowing out of the bag (5) and entering said vacuum sealing chamber (8) and from being deposited on the bag opening.

Figure 8:
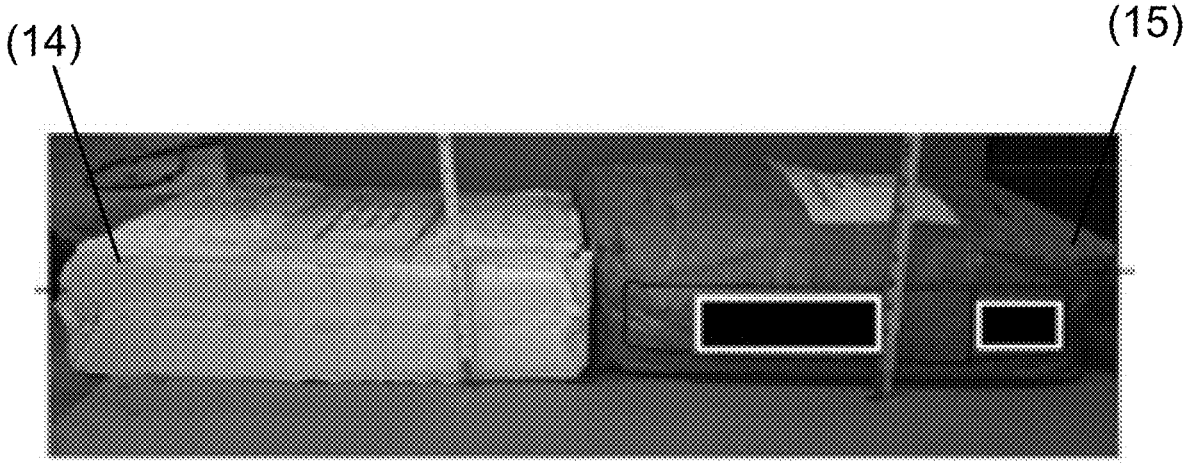
FIG. 8 is a side view of a package of solid drilling fluid additive packaged by the present invention, adjacent to a package of solid drilling fluid additive packaged by conventional means.
Figure 9:
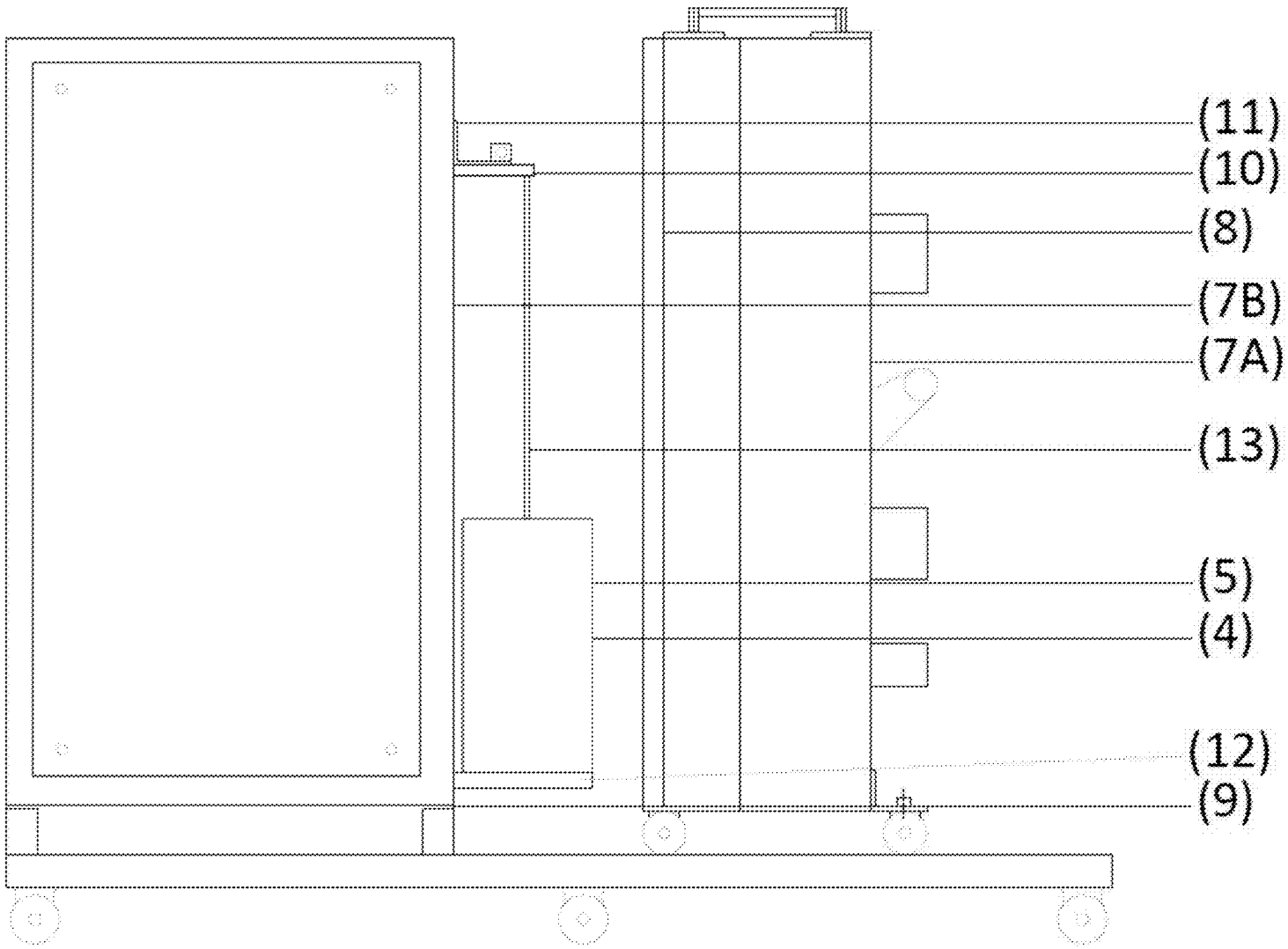
FIG. 9 is a side view showing the mould placed on the bag holder 12, prior to the first portion (7A) and second portion (7B) of the apparatus being brought in sealing engagement. Headspace (13) is located between the mould opening (5) and sealing element (10).

To carry out the process of vacuum packaging, a packaging bag (6) is aligned to the inner cavity of mould (4). Vacuum packaging bags play an important role in the vacuum sealing technology, the water vapour transmission rate and oxygen transmission rate of the bag determining the shelf life of the product. Preferably, the packaging bag (6) used in the present process is a multilayer packaging bag having water vapour transmission rate of about 2.5 $gm/m^2$/day and oxygen transmission rate of about 30 $cc/m^2$/day. The bag (6) is loaded with solid drilling fluid additive and the mould (4) is placed on the holding rack (12) of the second portion (7B) of the apparatus and the open end of the packaging bag (6) is attached to the bag holder (11). The first and second portion (7A & 7B) of the apparatus are placed in sealing engagement such that the filled mould (4) with the packaging bag (6) is disposed within the vacuum sealing chamber (8) and the headspace (13) between the sealing element (10) and the mould opening (5) and the distance between the sealing element (10) and the drilling fluid additive contained within the mould (4), is at least 250 mm and mould (4) thus positioned, is open at the top. The vacuum source (9) is activated to evacuate air from the packaging bag (6) and the vacuum sealing chamber (8). After evacuation of air, the sealing element (10) is activated to seal the packaging bag (6). The vacuum packaged sealed bag is released from the vacuum sealing chamber (8) to obtain a finished brick of vacuum packaged solid drilling fluid additive (13) as illustrated in FIG. 7. FIG. 8 shows the vacuum packaged solid drilling fluid additive (14) of the present invention adjacent to solid drilling fluid additive packaged by conventional means (15). As can be seen the vacuum packaged additive (14) of the present invention is compact as compared to the additive packaged by conventional means without using vacuum sealing technology (15).

Experiments were carried out to determine the effectiveness of the present invention to package solid drilling fluid additives. The test procedure was to package a low bulk density drilling fluid additive by conventional packaging method and by the vacuum sealing method and apparatus of the present invention and to compare the results. The volume of the sealed bag was measure in both cases. The improved and advantageous properties of the packaging apparatus of the invention and the method of packaging are effectively demonstrated by the experiments reported in the following examples:

A. Experiment with Powdered Emulsifiers

Example 1: Conventional Technology

Powdered emulsifier of bulk density 0.585 gm/cm$^3$ was packaged and sealed in a regular 22.7 kg HDPE line paper bag without using vacuum sealing technology.

The dimensions of the sealed bag were as follows:

| Length | Height | Width | Volume |
|---|---|---|---|
| 580 mm | 380 mm | 175 mm | 38570 cm$^3$ |

It was observed that 36 of such packaged bags fit on the pallet and a total of 817.2 kg of material could be shipped per shipping container.

Example 2: Present Invention

When the Powdered emulsifier used in Example 1 was vacuum packed with the vacuum sealing apparatus and method of this invention, it was observed that 40 bags of 22.7 kg of HDPE line paper bag could fit on the pallet. Each shipping container could be packed with 908 kgs of material. Further, no material escaped from the bag during vacuum creation to deposit on the mouth of the bag or in the vacuum sealing chamber of the apparatus.

The dimensions of the bag sealed with the technology of the present invention, were as follows:

| Length | Height | Width | Volume |
|---|---|---|---|
| 560 mm | 380 mm | 150 mm | 31920 cm$^3$ |

Conclusion: The present invention results in reduction in volume of the packaged bags by 6650 m$^3$, thereby yielding 17.24% reduction in volume of the packaged product and a corresponding percentage increase in space available for transportation of material. The bulk density of the vacuum packaged additive increased from 0.585 to 0.711 gm/cm$^3$. Further, the present invention provides a solution to the problem of fine particles escaping from the bag during vacuum creation.

B. Experiment with Lost Circulation Material

Example 3: Conventional Technology

Lost Circulation Material of bulk density 0.47 gm/cm$^3$ was packaged and sealed in a regular 22.7 kg HDPE line paper bag without using vacuum sealing technology. The dimensions of the sealed bag were as follows:

| Length | Height | Width | Volume |
|---|---|---|---|
| 580 mm | 420 mm | 195 mm | 47502 cm$^3$ |

It was observed that 30 such packaged bags fit on the pallet and a total of 345 kg of material could be shipped per shipping container.

Example 4: Present Invention

When the Lost Circulation Material used in Example 3 was vacuum packed with the vacuum sealing apparatus and method of the present invention, it was observed that 48 bags of 11.5 kg of HDPE line paper bag could fit on pallet. Each shipping container could be packed with 391 kgs of material. Further, no material escaped from the bag during vacuum creation.

The dimensions of the bag sealed with the technology of the present invention, were as follows:

| Length | Height | Width | Volume |
|---|---|---|---|
| 525 mm | 370 mm | 130 mm | 25252.5 cm$^3$ |

Conclusion: The present invention results in reduction in volume of the packaged bags by 22249.5 cm$^3$, thereby yielding thereby yielding 46.8% reduction in material volume of the packaged product and a corresponding percentage increase in space available for transportation of material. The bulk density of the vacuum packaged additive increased from 0.47 to 0.88 gm/cm$^3$. Further, the present invention provides a solution to the problem of fine particles escaping from the bag during vacuum creation.

The percentage increase in bulk density of the vacuum packaged material of the present invention was found to be in the range of 25 to 100%, depending upon the nature of the material.

The bulk density of the vacuum packaged drilling fluid additive was in the range of 0.5 to 2.0 gm/cm$^3$, depending upon the type of additive used.

The foregoing description provides illustration and description but is not intended to be exhaustive or to limit the disclosure to the precise form disclosed. Modifications and variations are possible in light of the above teachings or may be acquired from practice of the disclosure.

We claim:

1. An apparatus for vacuum packaging solid drilling fluid additives comprising a vacuum sealing chamber, a vacuum source for evacuating air from the vacuum sealing chamber, a rigid, hollow, open-topped mould having an opening for receiving a packaging bag for filling with solid drilling fluid additive, said mould positionable inside the vacuum sealing chamber in a manner wherein the mould remains open at the top, and a sealing element for sealing the packaging bag after the air in the vacuum sealing chamber has been evacuated, characterized in that, a headspace of at least 250 mm is provided between the sealing element and the mould opening; and the vacuum sealing chamber is adapted to receive said mould.

2. The apparatus as claimed in claim 1 wherein the the mould has a length greater than a height.

3. The apparatus as claimed in claim 1 wherein the packaging bag is a multilayer packaging bag having water vapour transmission rate of about 2.5 $g/m^2/day$ and oxygen transmission rate of about 30 $cc/m^2/day$.

4. A method of vacuum packaging solid drilling fluid additives using an apparatus comprising a vacuum sealing chamber, a vacuum source for evacuating air from the vacuum sealing chamber, a rigid, hollow, open-topped mould having an opening for receiving a packaging bag, said mould positionable inside the vacuum sealing chamber during vacuum creation and a sealing element for sealing the packaging bag, the method comprising the steps of:

placing the packaging bag inside the inner cavity of the mould;

loading the packaging bag with solid drilling fluid additive;

placing the mould with the packaging bag containing solid drilling fluid additive inside the vacuum sealing chamber so that the mould remains open at the top and a headspace between the sealing element and the opening of the mould is at least 250 mm;

securing an open end of the packaging bag to the vacuum sealing apparatus;

activating the vacuum source to evacuate air from the packaging bag and the vacuum sealing chamber; and activating the sealing element to seal the packaging bag to obtain vacuum packaged drilling fluid additive, characterized in that, the headspace between the sealing element and the drilling fluid additive is at least 250 mm.

5. The method as claimed in claim 4 wherein the packaging bag is a multilayer packaging bag having water vapour transmission rate of about 2.5 $g/m^2/day$ and oxygen transmission rate of about 30 $cc/m^2/day$.

6. The method as claimed in claim 4 wherein the bulk density of the vacuum packaged drilling fluid additive is in the range of 0.5 to 2.0 $g/cm^3$.

7. A vacuum packaged solid drilling fluid additive packaged by the method of claim 4.

8. The vacuum packaged drilling fluid additive as claimed in claim 7 wherein the bulk density of the vacuum packaged additive is in the range of 0.5 to 2.0 $g/cm^3$.

9. The vacuum packaged drilling fluid additive as claimed in claim 7 wherein the additive is packaged in a multilayer packaging bag having water vapour transmission rate of about 2.5 $g/m^2/day$ and oxygen transmission rate of about 30 $cc/m^2/day$.

* * * * *